US005956876A

United States Patent [19]

Burdette et al.

[11] Patent Number: 5,956,876

[45] Date of Patent: Sep. 28, 1999

[54] VENDING MACHINE FACE

[75] Inventors: Crystal Gaye Burdette; Eddie Wayne King, both of Marietta; William James Saunders, Lithonia, all of Ga.

[73] Assignee: The Coca-Cola Co., Atlanta, Ga.

[21] Appl. No.: 08/845,376

[22] Filed: Apr. 24, 1997

[51] Int. Cl.[6] ..... G09F 7/02

[52] U.S. Cl. ..... 40/611; 40/575; 312/234.1

[58] Field of Search ..... 40/611, 568, 573, 40/575; 312/234.1, 321.5, 293.1, 293.2, 204; 52/38, 456

[56] References Cited

U.S. PATENT DOCUMENTS

| | | | |
|---|---|---|---|
| 3,172,713 | 3/1965 | Rupert . | |
| 3,697,147 | 10/1972 | Schulte | 312/204 X |
| 3,752,357 | 8/1973 | Harris | 312/321.5 X |
| 3,803,738 | 4/1974 | Weiss | 40/306 |
| 4,326,620 | 4/1982 | Felix et al. . | |
| 4,380,130 | 4/1983 | Bachmann et al. | 40/573 X |
| 4,454,670 | 6/1984 | Bachmann et al. | 40/584 |
| 4,471,548 | 9/1984 | Goudie | 52/38 X |
| 4,516,343 | 5/1985 | Stilling | 40/574 |
| 4,682,432 | 7/1987 | Taylor et al. | 40/573 |
| 4,940,160 | 7/1990 | Williams . | |
| 4,980,998 | 1/1991 | Amstutz et al. | 52/38 X |
| 5,048,251 | 9/1991 | Turner | 52/454 |
| 5,091,713 | 2/1992 | Horne et al. . | |
| 5,255,968 | 10/1993 | Craven . | |
| 5,265,360 | 11/1993 | Reiss et al. | 52/38 X |
| 5,379,540 | 1/1995 | Howard | 40/573 X |
| 5,385,225 | 1/1995 | Chen et al. . | |
| 5,421,112 | 6/1995 | Knorr | 40/611 X |
| 5,471,794 | 12/1995 | Nishioka . | |
| 5,488,656 | 1/1996 | DeArkland . | |
| 5,499,707 | 3/1996 | Steury . | |
| 5,505,333 | 4/1996 | Shibazaki et al. . | |
| 5,509,225 | 4/1996 | Minh et al. | 40/611 |
| 5,598,655 | 2/1997 | McGarrah | 40/611 |
| 5,613,874 | 3/1997 | Orlando et al. . | |
| 5,680,721 | 10/1997 | Hine, Jr. | 40/611 |

FOREIGN PATENT DOCUMENTS

WO92/18954 10/1992 WIPO .

*Primary Examiner*—Joanne Silbermann
*Attorney, Agent, or Firm*—Birch, Stewart, Kolasch & Birch, LLP

[57] ABSTRACT

A vending machine face has a number of modules that are mechanically fastened to an underlying frame. These modules can be easily removed and replaced in the field so that the appearance of a vending machine can be changed with promotions, new interactive pieces can be added, the location of the vend selection buttons can be changed, recessed display compartments can be used and/or different light boxes with various graphics can be inserted and removed. This arrangement will provide for the ability to completely change the appearance of the vending machine on site. The vending machine can be customized for specific account location and can be switched from one promotion to another relatively easily. A frame for holding the modules is provided. The frame and modules be a door for the vending machine. This door can be flat or have a contoured, undulating outer face. Also, the door can be rectangular or have other shapes as desired.

31 Claims, 8 Drawing Sheets

VENDING MACHINE FACE

BACKGROUND OF THE INVENTION

1. Field of the Invention

The present invention relates to a vending machine face having a frame and a plurality of changeable modules.

2. Description of the Background Art

With today's vending machines, it is difficult to effectively customize a machine for a specific account location. Existing vending machines will use a static cling strip on the surface which is often times stolen. A huge gap also exist in consumer communication. The recent introduction of new packages and brands causes a need to clearly communicate to the consumer what she or he can find in a particular vending machine.

Also, a need exists for mounting interactive technology pieces within vending machine doors. Such pieces could include coupon dispensers or video screens. There is little flexibility in today's door whereby these features can easily be accommodated. It is known from U.S. Pat. No. 4,454,670 that a single utility module can be used in a vending machine door. This module, however, only covers a small area of the face of the vending machine and therefore does not have a great impact on the overall appearance of the vending machine. Moreover, the components which can be switched in this space are rather limited. There is only a small area to insert different modules.

SUMMARY OF THE INVENTION

Accordingly, it is the primary object of the present invention to provide a vending machine face which can house a plurality of easily changeable modules.

It is a further object of the present invention to provide a vending machine face which can completely change the appearance of a vending machine on site.

It is another object of the present invention to provide a vending machine face which can customize the machine for a specific account location.

Yet another object of the present invention is to provide a vending machine face which can easily switch from one promotion to another.

Still another object of the present invention is to provide a vending machine face which will communicate to the consumer what the machine has to offer.

It is yet another object of the present invention is to provide a vending machine face with space to mount various interactive technology pieces.

Still another object of the present invention is to provide a vending machine face which can easily be differentiated from a competitors.

These and other objects of the present invention are fulfilled by providing a vending machine face with a frame and a plurality of modules. The modules are readily detachably mounted on the frame. Modules, when mounted on the frame, and the frame itself forming the face of the vending machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
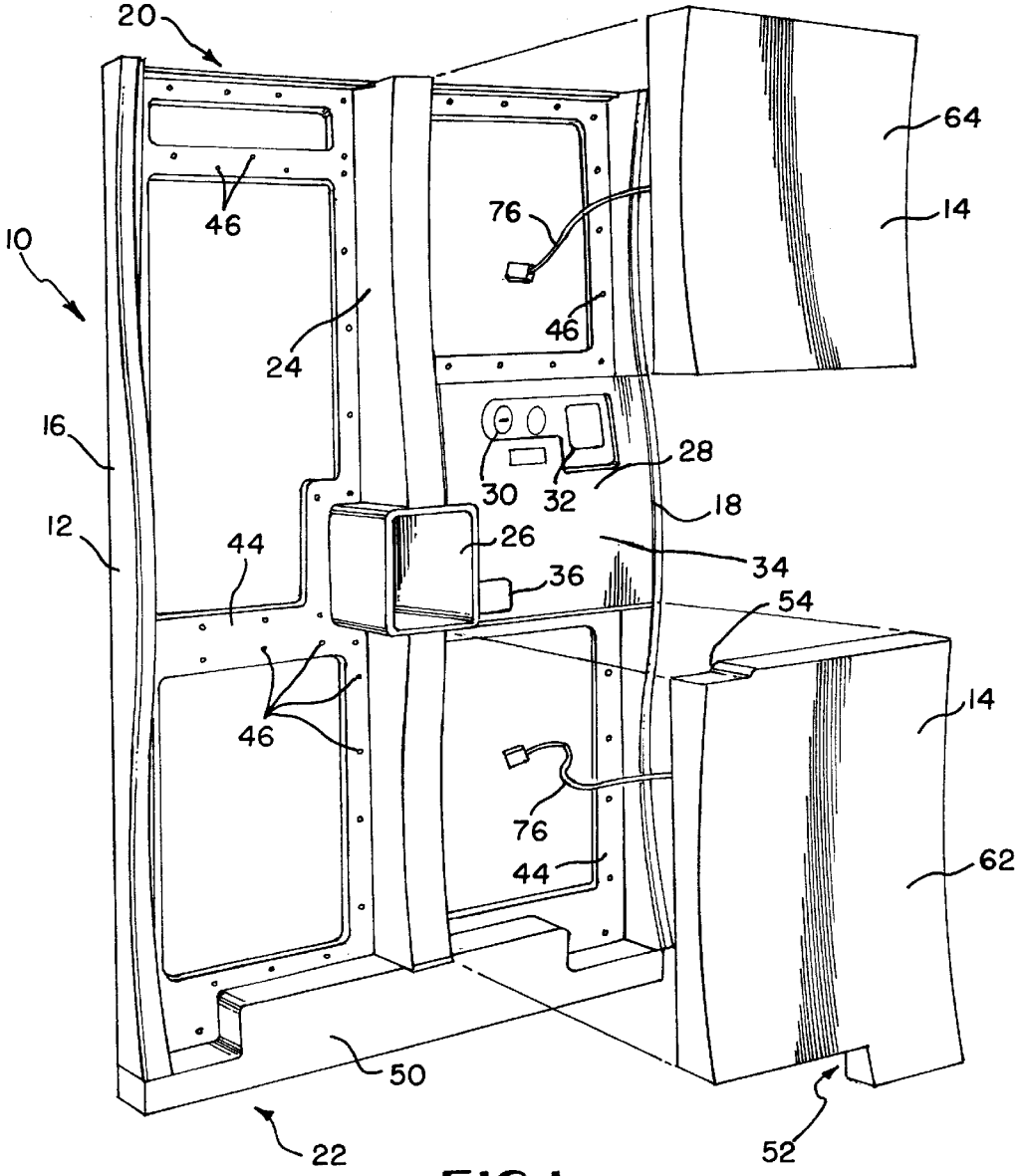
FIG. 1 is an exploded perspective view of the vending machine face of the present invention showing the frame and some detached modules.
Figure 2:
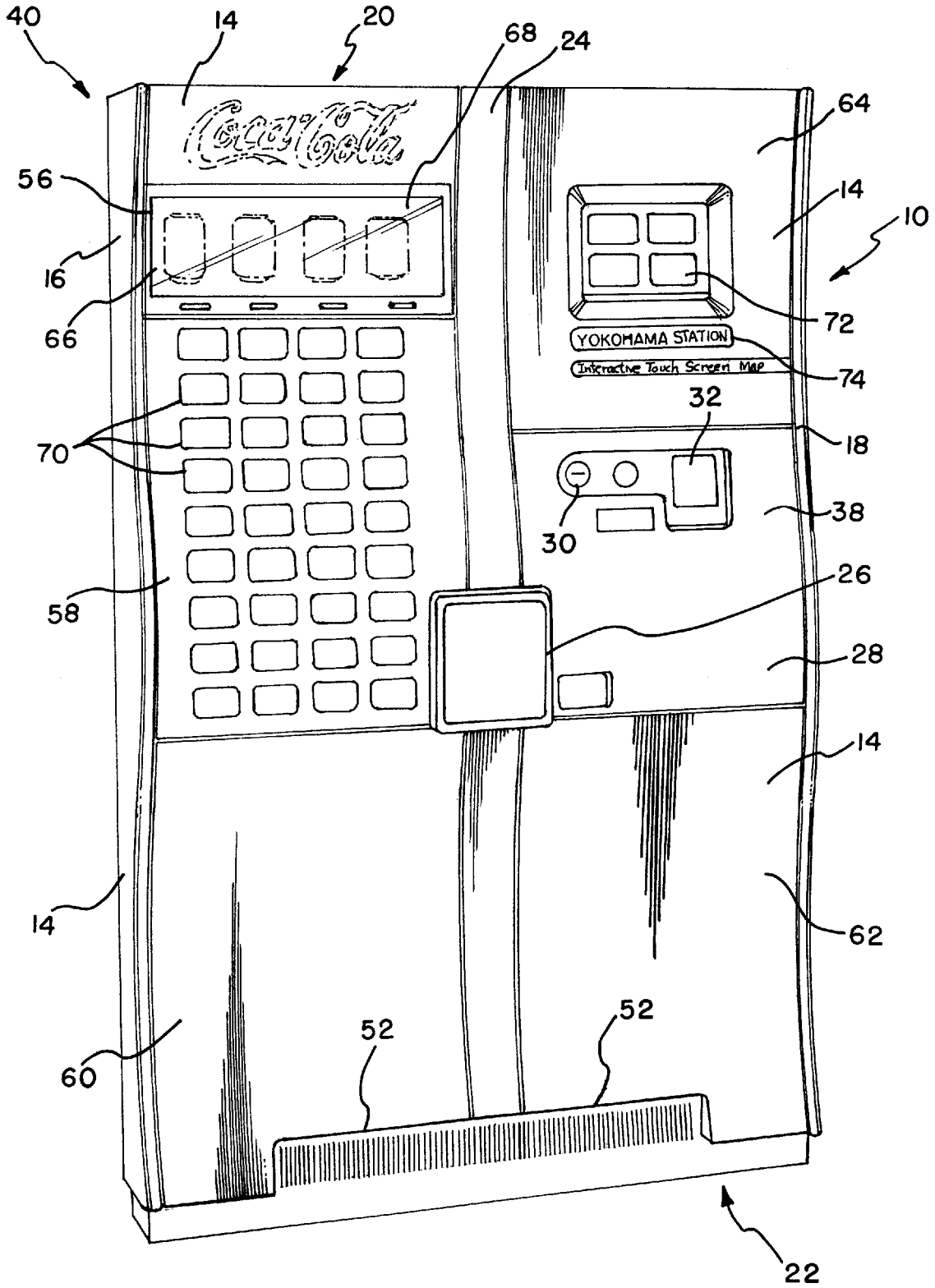
FIG. 2 is a perspective view of a first embodiment of the vending machine face of the present invention.

Referring in detail to the drawings and with particular reference to FIGS. 1 and 2, a first embodiment of the vending machine face 10 is shown. As indicated in FIG. 1, this vending machine face 10 includes frame 12 and a plurality of modules 14. The frame 12 has two outer side edges 16 and 18 with a curved outer surface. This curved or undulating outer surface will match with the outer surfaces of the modules 14 to form a wave or contoured vending machine face 10 as shown in FIG. 2. In side view, this vending machine face 10 would have a thick top portion, a reduced thickness section, a thicker middle portion, another reduced thickness portion and finally, a thicker bottom portion from the top 20 to the bottom 22 of the vending machine face 10.

Apart from the side edges 16, 18, the frame 12 also has a central column 24. This column 24 in this first embodiment has a similar contoured or undulating outer surface which matches the outer surfaces of the side edges 16, 18 in the first embodiment. The outer surface of the central column 24 and of the side edges 16, 18 are exposed when the modules 14 are mounted on the frame as seen in FIG. 2.

A delivery port 26 is located generally midway between the top 20 and the bottom 22 of the face in the central column 24 of the first embodiment of face 10. This delivery port 26 provides for a discharge opening from the vending machine. Beverages or other items can easily be dispensed through this port 26. The height of this port and its position on face 10 of the vending machine can be varied. For example, the delivery port 26 can be located closer to the bottom 22 of the face or could be located on the right or left side of the front of the face 10. It is contemplated, however, that when a frame 12 is constructed, the delivery port 26 will be built therein. Once this frame 12 is constructed, the location of the delivery port 26 will not normally change.

While the modules 14 can be readily changed as will be discussed below, this delivery port 26 is generally fixed in position in a particular frame. However, as noted above, different frames can have the port 26 located at different positions. Therefore, if a frame were removed from a vending machine and a new frame placed thereon, it would be a relatively easy matter to change the location of the delivery port 26.

Adjacent to the delivery port 26 in FIG. 1 is a vault or transaction area 28. This vault 28 is also fixed on the frame. The vault 28 provides for a coin slot 30, a bill validator 32, and a secured coin area 34. Secured coin area 34 is in the interior of vault 28 and will receive coins and bills from the slot 30 and the validator 32. In addition, the vault 28 can have a pricing label which displays the price for the various good to be dispensed by the vending machine. A return coin slot 36 can also be provided on the vault 28.

A cover 38 can be placed on the vault such that its exterior is flush with the adjacent central column 24 and side edge 18 as shown in FIG. 2. This cover 38 can be fixedly mounted to the frame 12 or it can be locked in position and freed only when the rear of the face 10 is exposed such as during service of the machine. This cover 38 will have an opening for the coin slot 30, bill validator 32 and return coin slot 36, for example. The color, graphics and/or texture of the cover 38 can match the remainder of the vending machine face 10 to provide for an uninterrupted appearance for the machine. Rather than, placing a separate cover 38 on the vault, the frame can be constructed such that the face of the vault is integrally formed thereon. It is merely necessary that a secured area be provided in the vault 28 for safely storing currency.

Figure 7:
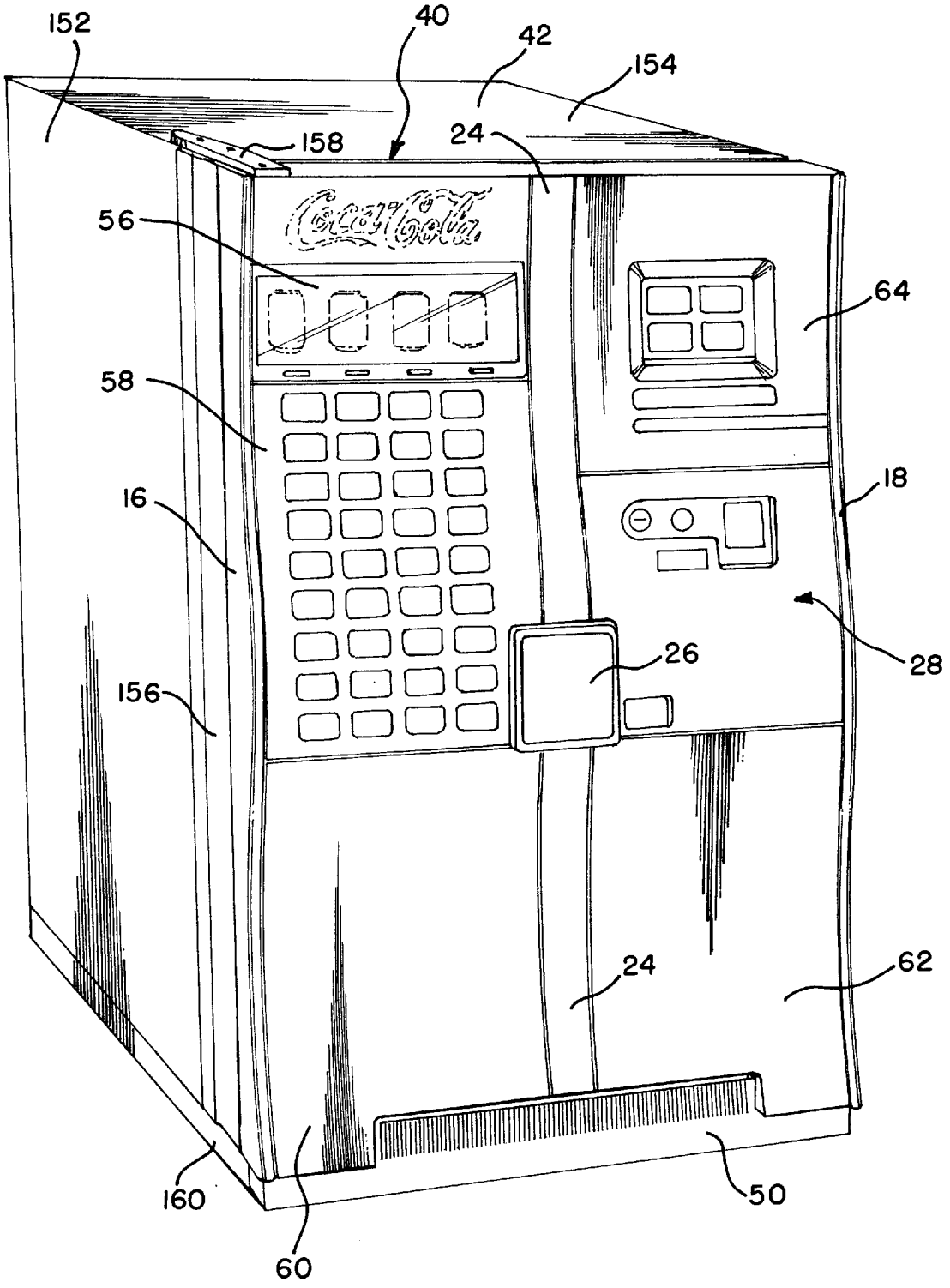
FIG. 7 is a perspective view of the first embodiment of the vending machine face on a vending machine.

When the face 10 is applied to a vending machine, this face can be utilized as a door 40 for the vending machine as shown in FIG. 7. When the door 40 is pivoted to an open position, then the rear of the vault 28 can be exposed. Service personnel can then remove the coins and bills and conduct any necessary maintenance. This arrangement of the face being a door 40 for a vending machine 42 will be discussed in more detail below.

Similarly to the delivery port 26, the vault 28 can be located in any desired position on the face 10 of the vending machine. Once a location is set for the vault 28, it is contemplated that it will be rigidly mounted on the frame 12. If it were desired to change location of the vault 28 on the face of the vending machine, the entire frame structure 12 could be interchanged and a new face provided for the vending machine 42 with a different vault location. Alternatively, the vault could be detachable from the frame, but its attachment to the frame must be sufficiently secure to prevent it from being torn from the machine.

As noted above, the face 10 of the vending machine can be a door 40 to a vending machine 42 as seen in FIG. 7. This face 10 will pivot in a conventional manner to provide access to the interior of the vending machine 42. The vending machine 42 is basically a three dimensional rectangular structure having vertical sides 152 joining horizontal top 154 and bottom sides, respectively. The structure of the vending machine 42 is completed by rear planar surface and front face 10 having the door 40 formed from the frame 12 and any modules 14 mounted thereon. A sealing skirt 156 will be provided between the door and the vending machine body and hinges 158 are provided at the top and bottom corner of the door 40. A bottom surface of the vending machine can act as a load bearing pad 160 or the like and extend outwardly from the main body portion of the machine beneath the door structure 40. The face 10 can be applied to conventional vending machines or newly developed vending machines.

Figure 8:
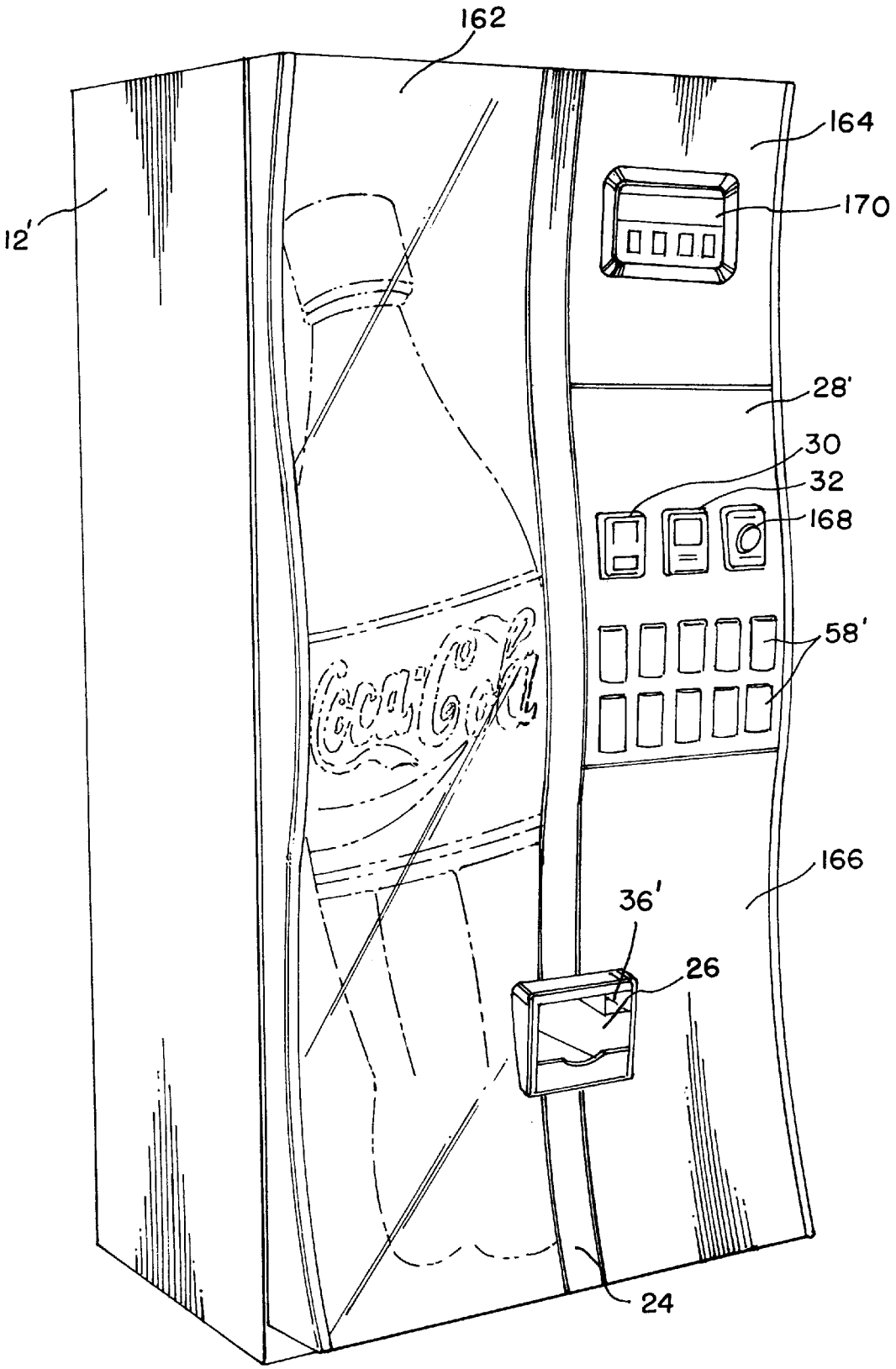
FIG. 8 is a perspective view of the first embodiment of the vending machine face having different modules from FIG. 7 on a vending machine.

In FIG. 8, a modified form of the vending machine face 10 from FIG. 7 is shown. This vending machine face 10 is also shown as a door 40 to vending machine 42. Similarly to FIG. 7, this door 40 of FIG. 8 will be pivotable between and open and closed position. Also, similarly to FIG. 7, the face 10 has the wave or contoured configuration.

In the face 10 of FIG. 8, the three left-hand modules 56, 58 and 60 have been replaced with a single one-piece module 162. As previously discussed, multiple modules can be interchanged with single modules as shown in FIG. 8, for example. Also, in FIG. 8, the delivery port 26 is shown at a lower location than that of FIGS. 1, 2 and 7. It is contemplated that a different frame 12' would be interchanged with the frame 12 of FIGS. 1, 2 and 7 because the delivery port 26 would be fixed in the central column 24.

In FIG. 8, an upper right-hand module 164 and lower right-hand module 166 are shown above and below the vault 28', respectively. This vault 28' of FIG. 8 not only includes a coin slot 30 and a bill validator 32 similarly to the vault 28 of FIG. 1, but additionally includes a frequent buyer card slot 168 and vend selection buttons 58'. Accordingly, instead of being mounted in a separate module, the vend selection buttons 58' are a part of the vault 28' or transaction area. The vault 28' would have a secured interior coin and currency area for storing money similarly to vault 28. It is contemplated that the vault 28' would be permanently mounted on the frame 12'. Therefore, the vend selection buttons 58' would be fixed to the frame. The graphics in these buttons could, of course, be changed in order to vary the drinks vended from the machine.

In association with the vault 28', a return coin slot 36' is provided. Unlike the earlier described slot 36, this return coin slot 36' is mounted in the upper corner of the delivery port 26. Internally, this slot 36' is connected to the vault 28' such as by a chute extending within the central column 24. It is convenient for the consumer when the slot 36' is provided in the area of the delivery port 26. The consumer can retrieve their purchase and returned coins from generally the same area of the vending machine.

The modules 162, 164 and 166 of FIG. 8 are contemplated as being light boxes with appropriate graphics. Other modules could, of course, be used. The upper right-hand module 164 additionally includes a display screen 170. This could be an interactive touch screen, a television, a video or other game, a ticket vender or a display screen. Information about the vended products, about the amount of money remaining on a consumer's frequent buyer card or about other subjects can be displayed. The utilized frequent buyer card can be a debit type card where money is initially credited to the card and then subtracted therefrom or a debit card which automatically deducts purchases from a consumer's account. Alternatively, the frequent buyer card could be a credit type card.

Returning to FIG. 1, the frame 12 also includes a back panel 44 on each side of column 24. The thickness of back panel 44 is considerably less than the side edges 16, 18 and central column 24 of the frame 12. All of these elements are rigidly interconnected to make the frame 12. It is contemplated that the back panels 44 will be nondetachably mounted to the side edges 16, 18 and central column 24, but it is possible to provide a nut and bolt or other rigid connection means for detachably mounting these panels 44 to the rest of frame 12.

Figure 3:
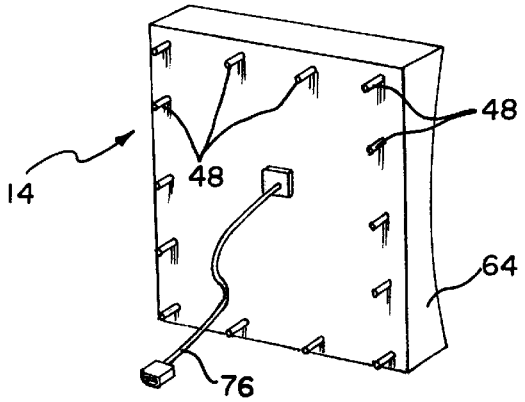
FIG. 3 is a rear perspective view of one of the modules of the present invention.

A plurality of openings 46 are provided on the back panels 44 for receiving elements 48 on the rear face of modules 14. In FIG. 3, uniformly spaced elements 48 are shown around the periphery of the module 14. It is not necessary that these elements 48 be uniformly spaced or that any particular number of elements 48 be used. Rather, it is simply necessary for the elements 48 to conform to the placement of at least some of the openings 46 on the frame. These elements 48 will be inserted into the openings 46 in the back panel 44 in order to initially place the modules 14 on frame 12.

It can be the case that more openings 46 are provided in the back panels 44 of the frame 12 than there are elements 48 in the individual modules 14. In other words, a first module may be inserted in the frame leaving certain openings 46 unfilled. When this first module is replaced with a subsequent module, different openings 46 may be filled. Of course, it can be the case that all modules are generally built with the same spacing and number of elements 48 such that they will consistently match the openings 46 in the back panel 44 of frame 12. It should be noted, nonetheless, that different arrangements can be had. As another example, the elements 48 could be at some location on modules 14 other than around the periphery of the rear of the modules. For example, these elements 48 could be distributed throughout the back of the modules 14. It is merely necessary for the modules 14 to be securely held by the frame 12.

The modules 14 can be secured to the frame 12 in a number of different ways. For example, the elements 48 can be a nut and bolt arrangement. Bolts would be permanently mounted to the back of the modules 14. These bolts would be inserted through the openings 46 in the back panel 44 of the frame. Nuts would then be applied to the bolts such that the back panel 44 would be between the nut and the module 14. This would be one method for securing the modules 14 to the frame 12.

An alternative method for securing the modules 14 to the frame 12 is to use spring biased detent as the elements 48. These detent can include two spring biased sections which are normally urged away from one another in a direction perpendicular to the longitudinal axis of the element 48. In other words, the detent would move similarly to a clothes pin. The opposing sides could be squeezed together in order to be inserted through the openings 46. An enlarged section at the end of the detent would be inserted through the hole. The detent would be released to expand slightly to engage the rear of back panel 44 at opening 44 to thereby lock the module 14 to the frame 12. When it is desired to detach the module 14 from frame 12, the enlarged portion of the element 48 on the rear side of the back panel 44 can be squeezed together and the element can slip from the frame by pulling the detent from the opening 46.

Other arrangements for affixing the modules 14 to the frame 12 could be possible. It is merely contemplated that when modules 14 are mounted to the frame 12 they cannot be removed unless access to the back of the face 10 is provided. When the face 10 is a door 40 of a vending machine, such access would be provided by pivoting the door 40 to an open position. Service personnel can then easily remove any and/or all of the modules and replace them with new modules. This enables the appearance of the vending machine to easily be changed. It is contemplated that the frame including the exposed faces of sides 16, 18 and central column 24, the delivery port 26 and vault 28 will not normally be changed. If a cover 38 is provided on vault 28, this cover could of course easily be changed. Of course, it is possible to also change the location or look of any of the elements 16, 18, 24, 26 or 28, on a vending machine if so desired, by changing the frame 12 as noted above.

In FIG. 1, the frame 12 additionally includes a bottom beam 50. This beam has an enlarged mid-section and a reduced height at the ends thereof. The ends of the beam 50 intersect and/or are integrally formed with the side edges 16, 18 of the frame. Rather than using a different sized bottom beam 50, a beam with a uniform height could, however, be used. It should be noted that the modules 14 used in the lower portion of the frame 10 of FIG. 1 have matching cut-outs 52 for accommodating the top surface of the bottom beam 50. An additional cut-out 54 is also shown in the right-hand bottom module 62 in FIG. 1. This additional cut-out 54 will accommodate the port 26. The module positioned on the left-side of the central column 24 will have like cut-outs for accommodating the beam 50 and delivery port 26.

While only the back plates 44 and a bottom beam 50 extend between the central column 24 and side edges 16, 18 of the frame 12, it is also possible to use an upper beam if so desired. Likewise, any number of additional beams can be used. For example, a transverse beam can be provided across the mid-section of the face 10 or a plurality of beams can be used along the height of the face. These beams would, however, affect the placement of the modules 14. It is desired to minimize the number of beams used in order to maximize the exterior of the face covered by the modules 14.

Of course, the bottom beam 50, side edges 16, 18 central column 24 or any other beams which are used could be covered by the modules 14. For example, the modules could have a lip or other face portion which extends over and covers any portion of the frame. It is not contemplated however, that these portions which overhang the frame will be affixed to the frame such that attachment of the modules 14 will normally only be through the back panels 44. This will enable easy attachment and detachment of the modules 14. Nonetheless, attachment of the modules 14 to the frame 12 at locations other than back panels 44 is possible.

In FIGS. 1 and 2, five different modules are used on the vending machine face 10. These modules include a display module 56, vend selection buttons module 58, a left light box 60 a right light box 62 and an interactive touch screen 64. These individual modules will be explained in more detail below. Any of these modules can be easily removed from or inserted onto frame 12. It should be noted that the modules have been generically indicated by numeral 14 throughout the drawings.

As can been seen in FIG. 2, the outer surfaces of the modules 14 conform to the outer surfaces of the side edges 16, 18 of the frame as well as the outer surface of the central column 24. These modules were designed to give a wave or contour shape to the face of the vending machine 10. As will be explained below, the outer surfaces of the frame can have a smooth surface or other shape with the associated modules being preferably shaped to conform to the frame.

The display module 56 includes a recessed compartment 66 for displaying items, such as beverages, to be dispensed from the machine. A window 68 is provided to cover the recessed compartment 66 while permitting viewing of the interior of this compartment. This window 68 can be omitted if so desired.

Beneath the display module 56 is module 58 with vend selection buttons 70. While a matrix of four columns and nine rows have been indicated, it should be appreciated that any configuration of selection button 70 could be used. Also, the sizes for these buttons could be varied. For example, a larger button could be provided for the main item to be vended from the machine while smaller buttons are used for secondary items.

Beneath the vend selection button module 58 is a left light box 60. This left light box 60 generally matches the right light box 62. A display can be split between these two light boxes 60, 62 by the central column 24. On the other hand, each light box 60, 62 could have its own separate display.

It has been conventional in the art to provide a lexicon piece, for example a plastic sheet, having graphics thereon. This sheet has been slipped in and out of a holder in a light box affixed to the vending machine. In this manner, the display on the face of the vending machine could be varied. In the instant invention, however, it is contemplated that the entire module 14 can be removed. Therefore, removal of the module 60 or 66 would remove both the graphics on the face of the box as well as the underlying light box. A new light box with new graphics can be inserted in the machine. Alternatively, it is possible for the graphics piece to be switched thereby providing a new display while the old light box is reinserted into the machine.

Figure 9:
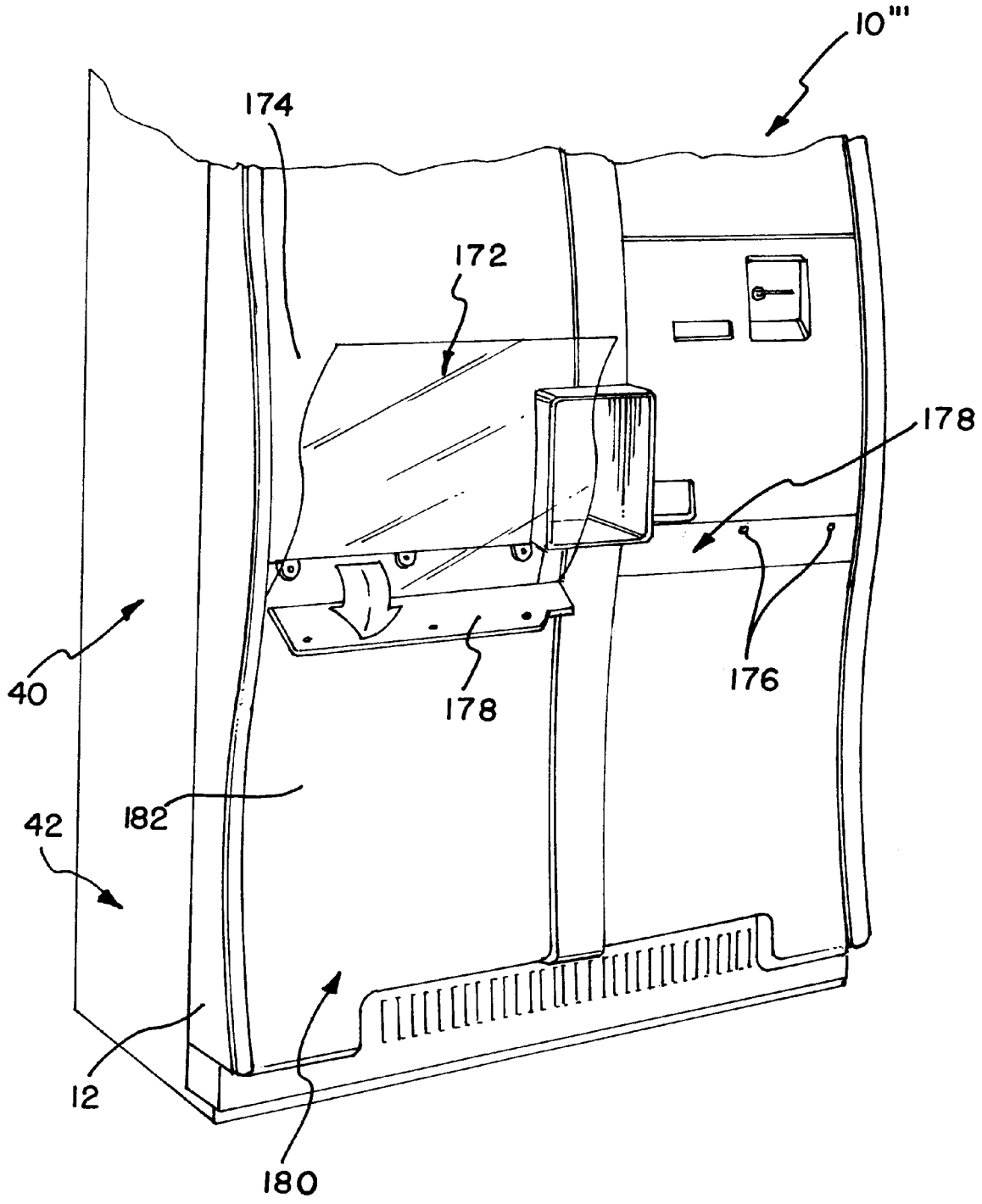
FIG. 9 is a sectional perspective view of fifth embodiment of the vending machine face on a vending machine.

A third alternative is shown in FIG. 9. A fifth embodiment of the vending machine face 10"" provides a detachable graphics piece 172 on the light box module 174. Upon insertion of an appropriate tool, such as a key, or odd shaped tool or keyed tool, into key locks 176, a flip down or access door 178 can be opened. While three separate key locks 176 are indicated in FIG. 9, any number or placement of key locks 176 can be used.

When the flip down door 178 is opened as shown on the left-hand side of the vending machine face 10"" of FIG. 9, the graphics piece 172 can be slid or otherwise removed from the module without the need for removing the module 174 from the frame 12. Therefore, a person could open the door 178 to access the graphics module 174 and change the graphics piece 172 without opening the vending machine door 40. This would allow the owner to give someone the task of changing out the graphics piece 172 without having to worry about the security of the money inside the vault area by giving that person a key to the flip down door 178 instead of a key to the vending machine door 40. Without the tool, however, the graphics piece 172 would be securely held in the module to prevent theft of this piece 172.

In FIG. 9, a graphics piece 180 is shown in the module 182 beneath module 174. The outer faces of the graphics pieces 172 and 180 conform to the outer side edges of the frame 12. The graphics piece 180 can be a thermoformed panel of clear material. A light box can be included in the module 182 or can be omitted. Any of the graphics pieces on the vending machine face 10"" or any of the other faces can be thermoformed panels of clear material. Any appropriate graphics can be included on these graphics pieces.

Without such a flip down door 178 as shown in FIG. 9 or other arrangement providing access to the graphics piece 172, it is nonetheless contemplated that changeover of the vending machine face will involve removing old modules and reinserting new ones therefor.

Returning to FIG. 2, above the right light box 62 is the vault 28 which was previously discussed. Above this vault 28 is the interactive touch screen module 64. The interactive touch screen 72 in the module 64 can display a map, for example. In particular, graphics 74 can be used to show the location for the vending machine. The interactive touch screen 72 can provide different selections for nearby locations. When a customer touches one of these locations, a map can appear showing the customer how to travel from the vending machine to the desired location. While four possible destination selections are indicated by the blocks in the screen 72 of FIG. 2, it should be appreciated that any number of destinations could be provided.

Rather than using a map service for this interactive touch screen 72, other modules could be used. For example, a coupon dispenser, video game, ticket dispenser or any other suitable module could be used.

Such replaceability is applicable for all of the modules 14. For example, the display module 56 could be replaced by an interactive touch screen module 64 such that the vending machine 10 would have two interactive touch screen modules 64. Alternatively, the light box module 60 and/or 62 could be replaced with a module having vend selection buttons, a display, an interactive touch screen, a coupon dispenser, or any other item. Moreover, the sizes of the modules can readily be varied. For example, the area now used in FIG. 2 for the modules 56, 58 and 60 could instead be used for two larger sized modules.

Using the frame of FIGS. 1 and 2, it is simply necessary that the modules 14 fit between the outer size edges 16, 18 and the central column 24. If the unequally sized modules 56 and 58 were replaced by equal sized modules, for example, it would be noted that a back plate 44 would not be provided in the frame of FIG. 1 in the area were these two equally sized modules adjoin one another. Such an arrangement is possible. However, it is contemplated that in normal operation, the periphery of each of the modules used will correspond to the spacing of the back panels 44; however, such an arrangement is not mandatory.

As seen in FIG. 3, the rear of the interactive touch screen module 64 has a power cord 76. This power cord will supply electricity to the interactive touch screen module 64. Also, control signals can be sent through the cord 76 if so desired. In FIG. 1, the right light box module 62 also has a power cord 76. An appropriate connection is provided on the vending machine to supply power to the various modules. It is noted that some modules may not need a power supply and therefore will not include the power cord 76. However, it is contemplated that a plurality of the modules will use a power cord in order to provide for different display vending and interactive feature of the machine. For example, the electricity for the lights in the light boxes 60, 62 will be supplied through the cords 76. Similarly, the electricity and control for the vend selection buttons 70 of the module 58 can be supplied through an appropriate cord 76. Alternatively, two separate cords could be used for electrical and control functions.

As seen in FIG. 2, when the modules 56, 58, 60, 62 and 64 are placed on frame 14, a smooth contoured vending machine face 10 is provided. The modules are so closely spaced to one another and to the edges 16, 18 of the frame and to the central column 24 that they cannot be pulled from the vending machine face 10. In order to dismount these modules, it is necessary to have access to the rear of the frame 12. This is normally accomplished by using the frame 12 as the door 40 of the vending machine. The door 40 is pivoted to an open position and then the rear of the modules can be accessed. The elements 48 can be detached from the frame and new modules 14 can be inserted on the frame. Therefore, it is relatively easy to change the appearance of the face 10 of the vending machine on site. It is not necessary to move the vending machine to a new location. It is contemplated that the frame 12 will normally stay attached to the vending machine. It is also possible to change this frame 12 if so desired in order to use a different type of frame with the vending machine. For example, if the location of the vault 20 or delivery port 26 were changed or if a flat vending machine face were to be used, then a new frame 12 would be required.

With this vending machine face 10, it is possible to customize the machine for a specific account location such as a school or university. It is also easy to switch from one promotion to another and the vending machine will clearly communicate to the consumer what is to be dispensed therefrom.

Figure 4:
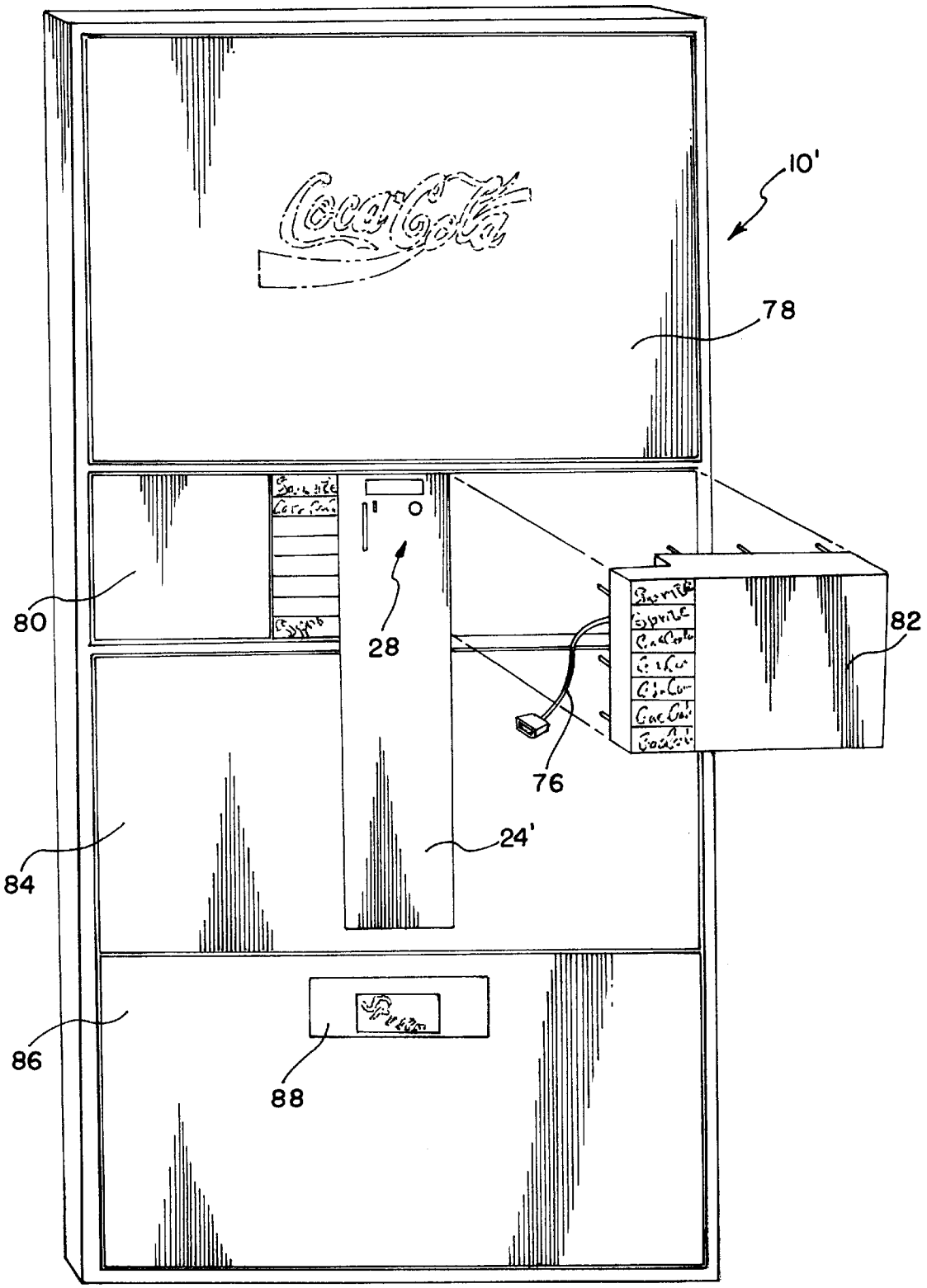
FIG. 4 is a front perspective view of a second embodiment of the vending machine face of the present invention.

Turning now to FIG. 4, a second embodiment of the vending machine face 10' is shown. This vending machine face 10' has five modules 78, 80, 82, 84 and 86. The first module 78 is located at the top of the machine face 10' and can include graphics or other information. Similarly to the right and left light box modules 60, 62 of the first embodiment, it is contemplated that this first module 78 will also be an entire light box which can be inserted into and removed from the machine.

Beneath this first module 78 are vend selection button modules 80 and 82. These vend selection modules 80 and 82 are located on opposite sides of the central column 24'. It should be noted in FIG. 4 that the central column does not extend from the top to bottom of the machine but is merely located in a central location. This central column 24' includes the vault 28 in an upper portion thereof. The second and third modules 80 and 82 are on opposite sides of the central column 24' in the second embodiment.

In FIG. 4, the right-hand third module 82 is shown removed from the machine. It should be contemplated that this module 82 can be inserted onto the underlying frame to thereby provide a flush exterior vending machine face 10'. Similarly to the first embodiment, all of the modules 78, 80, 82, 84 and 86 are readily removable from and inserted onto the underlying frame. This frame can be shaped to have appropriate spaced openings in order to receive the elements 48 on the rear of the modules 78 through 86. Unlike the first embodiment, the face 10' of the second embodiment is flat. Therefore, a frame having flat outer surfaces instead of the contoured or wave shape could be used as noted above.

Beneath the second and third vend selection button modules 80, 82 is a fourth module 84. This fourth module has a U-shape and surrounds the sides and bottom of the central column 24'.

Beneath this fourth U-shaped module 84 is a fifth module 86. This fifth module 86 has a pivotal door 88 providing access to the delivery port 26. Delivery port in the second embodiment is at a lower position than that shown in FIG. 2 for the first embodiment. As was previously noted, the location of the vault 28 and delivery port 26 can be varied. The fifth module 86 surrounds the door 88 and is provided over the delivery port 26. The door 88 could be omitted and direct access to the delivery port 26 could be had through the module 86. Instead of using a U-shaped module 84, two side-by-side modules could be used. Similarly, the bottom module 86 could be divided into two components.

It is contemplated that the central column 24' will extend downwardly and include the delivery port 26. This central column 24' will be beneath the connecting portion of the U-shaped module 84 as well as at least the upper portion of the fifth module 86 which is above door 88. This central column 24' can, in fact, extend along the entire length of the machine and therefore be behind modules 78, 84 and 86 or the column 24' could only be behind modules 84 and 86. As another alternative, the central column 24' could, in fact, only be provided in a central location of the machine as is visible in FIG. 4 and separate underlying frame structure could be provided for housing the delivery port 26. Great versatility is possible with the vending machine faces of the instant invention.

It is contemplated that instead of using a light box, the first module 78 could have an exterior wood grain appearance. The other modules 80, 82, 84 and 86 could also look like wood whereby the face 10' of the vending machine would resemble a cabinet or piece of furniture. Such a wooden appearance would provide a distinguished or sophisticated look for the vending machine. In fact, rather than a simulated wooden appearance, a wood veneer could be used on the faces of the modules. A power cord 76 would then not be needed for modules 78, 84 and 86. Of course, if a brand name on module 78 were to be illuminated, then such a power cord 76 would be necessary. Of course, treatments other than wood can be applied to the vending machine face 10'.

Figure 5:
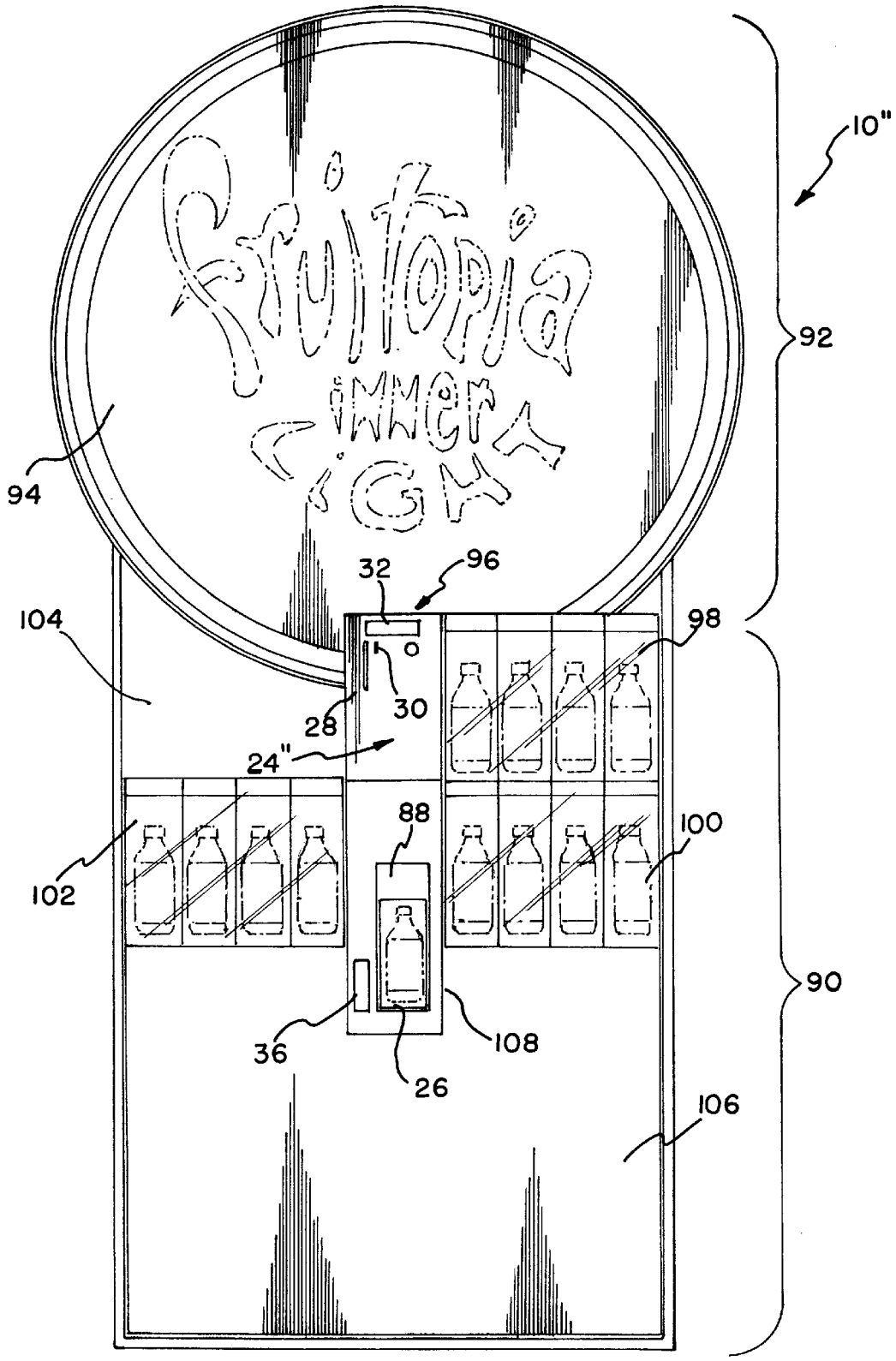
FIG. 5 is a front view of a third embodiment of the vending machine face of the present invention.

Turning now to FIG. 5, a third embodiment of the vending machine face 10" is shown. This vending machine face 10" will form a vending machine having a generally rectangular bottom area 90 and circular top 92. A single circular module 94 could be provided at the top of the face 10". This circular module 94 has a cut out portion 96 to accommodate the central frame 24" and upper row 98 of vend selection buttons. Instead of using a single one-piece circular module 94, this module could be divided into different sections if so desired.

The upper row of vend selection buttons 98 is above a lower row of vend selection buttons 100. These buttons 98 and 100 are on the right-hand side of the central column 24". Another row of vend selection buttons 102 is provided on the left-hand side of the central column 24". These vend selection buttons 98, 100 and 102 are each individual modules. Alternatively, the upper and lower rows 98, 100 could be combined into a single module if so desired.

It should be noted that the vend selection buttons 98, 100 and 102 are depressible compartments having bottles therein to indicate the beverage which will be dispensed when the button is depressed. Rather than using recessed compartment with bottle samples, graphics could merely be provided on the face of the different selection buttons 98, 100 and 102. Also, instead of displaying bottles, cans, beverage cups with graphics or any other suitable item to be vended can be displayed.

If the rows 90 and 100 were combined into a single module, then upper and lower buttons could be combined into larger sized buttons in order to display larger size items to be vended such as one or two liter bottle. In the embodiment of FIG. 5, vend selection buttons are on the right- and left-hand sides of the central column 24". Of course, these vend selection buttons could be provided on only one side of the central column 24" if so desired.

In order to fill in the right side of face 10", a module 104 is provided between the circular module 94, the central column 24" and the left-hand vend selection button module 102. This module 104 could include a light box with graphics or merely be a flat non-illuminated piece with graphics thereon.

At the bottom of the vending machine is a U-shaped module 106. This U-shaped module has a cut-out portion 108 to accommodate the central column 24". In the area of this cut-out 108, the delivery port 26 is provided. Similarly to the embodiment of FIG. 4, the delivery port 26 has a door 88. This door 88 has graphics indicating the item to be vended. This door 88 can be omitted, if so desired, to provide direct access to the delivery port 26.

Next to the delivery port 26 is the return coin slot 36. This return coin slot 36 is connected to the vault 28 within the central column 24". The vault 28 including the coin slot 30 and bill validator 32 is provided in the upper portion of the central column 24". In the embodiment of FIG. 5, it is contemplated that the central column 24" will only be positioned in a central location between the top and bottom of the vending machine face 10". However, this central column 24" could extend along the entire length of the vending machine face and be exposed or could extend along the entire length of the machine face and be behind the circular module 24 and the module 106. Many different arrangements are possible with the vending face 10". Also, the location for the vault 28 and the delivery port 26 could also be varied as noted above. Also as noted above, the frame can have outer surfaces which match the shape of the face. Therefore, instead of the contoured or wave shape of FIGS. 1 and 2 the frame can be flat similarly to FIG. 4. This frame of FIG. 5 differs from the frame of FIG. 4 in that it conforms to the generally rectangular bottom area 90 and circular top 92 of the face 10".

In the third embodiment of FIG. 5, an interactive touch screen module is not shown. However, any of the modules could be substituted to have such an interactive touch screen module. For example, the left-hand side vend selection buttons module 102 could be replaced by an interactive touch screen module. For that matter, a coupon dispenser, ticket dispenser, or any other suitable module could be used throughout this vending machine face 10".

Figure 6:
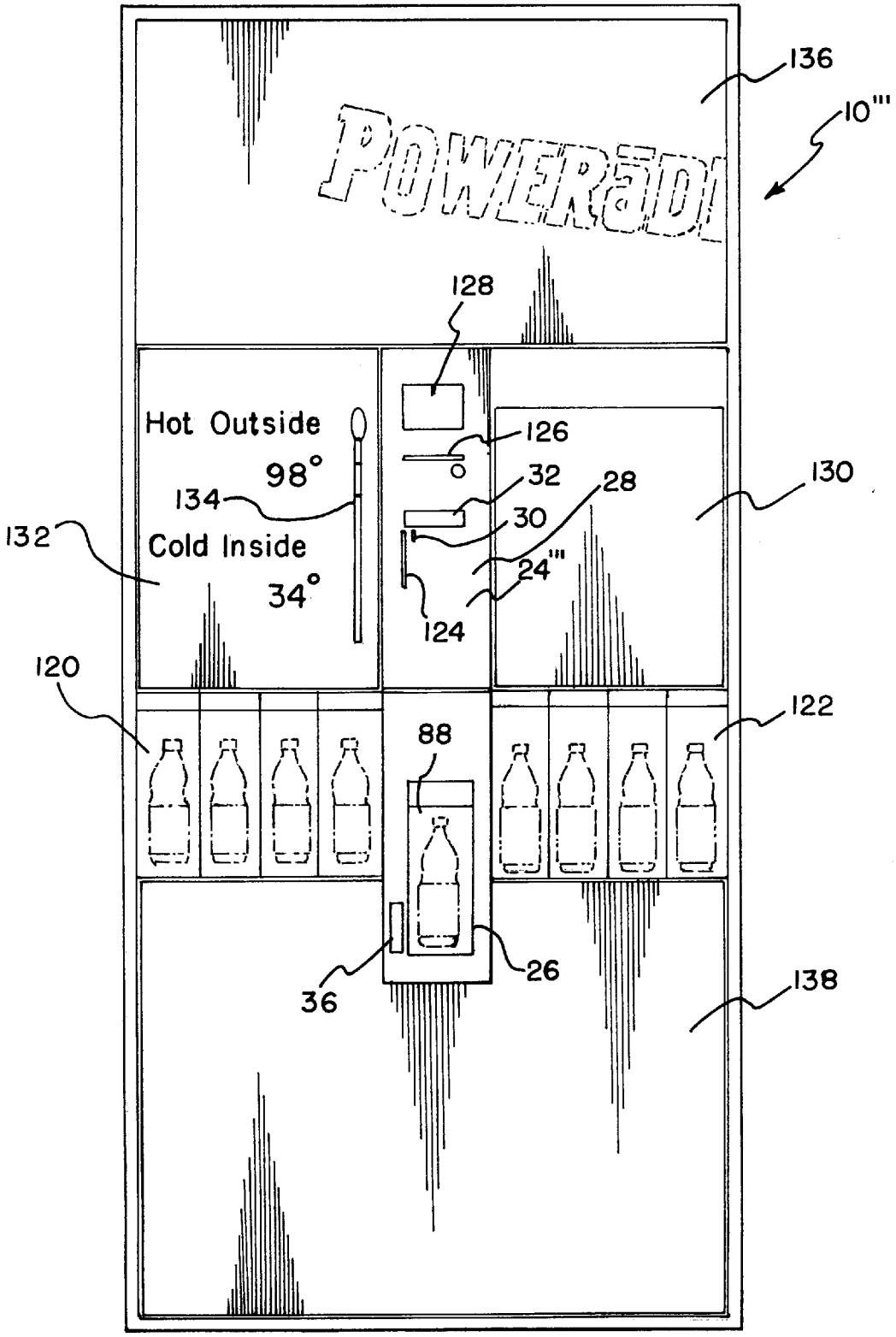
FIG. 6 is a front view of a fourth embodiment of the vending machine face of the present invention.

Turning now to FIG. 6, a fourth embodiment of the vending machine face 10'" of the present invention is shown. This vending face 10'" includes the right- and left-hand vend selection button modules 120, 122, respectively. These vend selection button modules 120, 122 are on opposed sides of the central column 24'". The delivery port 26 is also in the central column 24'" behind door 88. Graphics showing the item to be dispensed can be displayed on this door 88. Alternatively, the door can be clear in order for the consumer to see the item vended from the machine. Other possible doors could be used or the door 88 could simply be omitted to provide direct access to the delivery port 26, if so desired.

Adjacent to the delivery port 26 is the return coin slot 36 similarly to the embodiment of FIG. 5. This return coin slot 36 is connected to the vault 28 provided in the upper portion of the central column 24'". Vault 28 includes a coin slot 30, bill validator 32 and a credit card or debit card unit 124. Above the vault 28 is a card dispenser 126. Coupons, tickets or other items can be dispensed from the card dispenser 126. Information about this card dispenser 126 can be provided on panel 128.

The card dispenser 126 is associated with the central column 24'" and vault 28 to provide some secured location for the dispensed tickets. These tickets could be subway or bus tickets, museum or athletic event admission tickets, phone cards, lottery tickets or any other type of ticket, coupon or token. The tickets may be paid for through the bill validator 32 and/or the coin slot 30 or they may be dispensed in conjunction with the purchase of a beverage or other item. If the ticket has some value, it is good to have its dispenser 126 associated with the secured coin area 34 and/or central column. On the other hand, if the ticket has little or no monetary value, such as a fortune, a coupon or other token, then the dispenser 126 could be located elsewhere on vending machine face 10'".

For example, the right-hand module 130 can have the dispenser 126 or could only have information about the vended card. Other graphics can be throughout this module 130. Also, an interactive touch screen module, a light box, a display module, vend selection buttons or any other module could be inserted in this area for the right-hand module 130.

On the left-hand side of the central column 24'", a thermometer module 132 is provided. A thermometer 134 can be provided in the module 132 to indicate the outside temperature as well as the temperature of the drink or other item to be vended. This sales technique is especially helpful in the summer when cool drinks are vended from the machine. It is possible, on the other hand, that hot drinks, such as coffee, could be vended from this machine. In such an instance, this thermometer would also be a useful advertising technique in cold weather. During temperate seasons or if some other advertising campaign were undertaken, the thermometer module 132 could be replaced with another appropriate module. For example, a light box with an appropriate graphics display could be substituted for the thermometer module 132.

At the top of the vending machine face 10'" is an upper light box module 136. This module 136 extends across the entire upper surface of the vending machine face 10'". Two separate light boxes could instead be used or any other combination of modules are possible.

At the bottom of the vending machine face 10'" is a lower light box module 138. Again, any suitable module or number of modules could be used in this area. The sizes of the modules could be varied, the number of the modules could be varied or the function of the modules can be varied throughout the vending machine faces of the instant invention.

The instant invention therefore provides an arrangement whereby the appearance of a vending machine can be completely changed on site. The machine can be customized for a specific location and it is easy to switch from one promotion to another. The items vended from the machine are quickly and easily communicated to the consumer. There is space for interactive technology pieces which can be easily inserted into the door of the vending machine. Offers, such as coupons, provide added value to the consumer. It is also possible to provide for interactive display systems such as video games or maps in order to provide entertainment or further information to a consumer. The vending machine faces of the instant invention stand out from conventional vending machine faces and thereby differentiate these machines from a competitor's.

The ease of use and unique appearance of the present vending machines have heretofore not been found in the prior art. Great flexibility is obtained with the instant vending machine faces. The door 40 of the vending machine is segmented into a number of modules 14 by the frame 12. These modules can be easily removed and replaced in the field so that a machine appearance can be changed with promotions, new interactive pieces can be added, etc.

While the vending machine face 10 of the first embodiment shown in FIGS. 1 and 2 has a contoured or undulating face, the vending face 10', 10" and 10'" are generally flat. As shown in FIG. 5, a rectangular and circular vending machine configuration can also be obtained. It should therefore be apparent that different shapes for the vending machine face can be had with the instant invention.

In the drawings, the marks, "Coca-Cola", "Sprite", "Fruitopia" and "Power-Aid" and the Swirl and the Contour Bottle are registered trademarks of The Coca-Cola Company of Atlanta, Ga.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A vending machine face comprising:

a frame having a front side and a rear side;

a plurality of modules, the modules being readily detachably mounted to the frame, the modules being detachable via the rear side of the frame, the modules when mounted on the frame and the frame forming the face of a vending machine, a major part of the face of the vending machine being formed by the modules, at least two of the modules having an electrical connection extending therefrom to supply power to the modules when the at least two modules are simultaneously mounted on the frame, the electrical connection being removable with the associated module.

2. The vending machine face as recited in claim 1, wherein the frame has a plurality of outer side edges which each have an undulating outer surface and wherein the modules have an outer surface which is adjacent a portion of the outer surface of at least one outer side edge, the outer surface of the modules conforms to a shape of the outer surface of the at least one adjacent outer side edge.

3. The vending machine face as recited in claim 1, wherein the frame includes a central column, the central column being exposed between at least some of the modules when the modules are mounted on the frame.

4. The vending machine face as recited in claim 3, further comprising a delivery port provided in the central column.

5. The vending machine face as recited in claim 4, wherein the vending machine face has a top and a bottom and wherein the delivery port is located generally midway between the top and the bottom of the vending machine face.

6. The vending machine face as recited in claim 1, further comprising a vault mounted on the frame and at least one of a secured coin area and a bill validator within the vault, the vault being exposed on the face of the vending machine and being at least partially surrounded by modules when the modules are mounted on the frame.

7. The vending machine face as recited in claim 6, wherein the vault is rigidly and nondetachably mounted on the frame.

8. The vending machine face as recited in claim 1, wherein at least one of the modules includes a light box.

9. The vending machine face as recited in claim 8, wherein at least one of the modules includes vend selection buttons.

10. The vending machine face as recited in claim 9, wherein at least one of the modules includes one of an interactive touch screen and a video game.

11. The vending machine face as recited in claim 1, wherein at least one of the modules includes an interactive touch screen.

12. The vending machine face as recited in claim 1, wherein at least one of the modules includes at least one video game.

13. The vending machine face as recited in claim 1, wherein at least one of the modules includes a dispenser.

14. The vending machine face as recited in claim 13, wherein the dispenser is for dispensing at least one of coupons and tickets and wherein the dispenser is mountable at a top of the vending machine face.

15. The vending machine face as recited in claim 1, wherein at least one of the modules includes vend selection buttons.

16. The vending machine face as recited in claim 1, wherein at least one of the modules includes a thermometer.

17. The vending machine face as recited in claim 1, further comprising a delivery port provided in the vending machine face and wherein at least one of the modules includes a recessed compartment for displaying contents to be dispensed from the delivery port.

18. The vending machine face as recited in claim 17, further comprising a window in the module with the recessed compartment for closing the compartment while permitting viewing of an interior of the compartment.

19. The vending machine face as recited in claim 1, wherein each of the modules has a front and a rear, the front of the modules being visible when the modules are mounted on the frame and the rear of the modules having an element for mounting the module to the frame.

20. The vending machine face as recited in claim 19, wherein the frame has a plurality of openings and wherein the element comprises a spring biased detente inserted into one of the openings in the frame.

21. The vending machine face as recited in claim 19, wherein the frame has a plurality of openings and wherein the element comprises a nut and bolt arrangement, the bolt being insertable into one of the openings in the frame and thereafter being locked to the frame by fastening the nut on the bolt.

22. The vending machine face as recited in claim 1, further comprising a delivery port and vault, the delivery port and vault both being rigidly and nondetachably mounted on the frame and both being exposed when the modules are mounted on the frame, the face of the vending machine being entirely covered by the plurality of modules except for an area surrounding the delivery port, an area surrounding the vault, and exposed portions of the frame, all of the modules being readily detachable from the frame.

23. The vending machine face as recited in claim 1, wherein the frame includes a central column, the central column being exposed between at least two of the modules when the at least two modules are mounted on the frame, the at least two modules each including a plurality of vend selection buttons.

24. The vending machine face as recited in claim 23, further comprising a vault and a delivery port provided in the central column, one of the plurality of modules having a discharge opening mountable over the delivery port on the central column, at least one of a secured coin area and a bill validator being provided within the vault.

25. The vending machine face as recited in claim 23, wherein the delivery port is provided in the central column.

26. The vending machine face as recited in claim 23, wherein at least one of the modules is generally circular and wherein a portion of the frame surrounds and conforms with a periphery of the generally circular module whereby the vending machine face has a generally circular portion.

27. The vending machine face as recited in claim 1, wherein the frame is a door to a vending machine.

28. The vending machine face as recited in claim 1, wherein the vending machine face has a top and a bottom and wherein at least one of the modules extends from the top to the bottom of the vending machine face.

29. The vending machine face as recited in claim 1, further comprising an access door on the vending machine face for providing access to an interior of a module adjacent the access door without accessing a rear of the module.

30. The vending machine face as recited in claim 1, wherein at least half of the face of the vending machine is formed from the modules.

31. The vending machine face as recited in claim 1, wherein a majority of the face of the vending machine is formed from the modules.

* * * * *